US007317451B2

(12) United States Patent
Kim

(10) Patent No.: US 7,317,451 B2
(45) Date of Patent: Jan. 8, 2008

(54) APPARATUS AND METHOD FOR DISPLAYING OUT-OF-RANGE MODE

(75) Inventor: Gi-Soo Kim, Incheon Metropolitan (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 110 days.

(21) Appl. No.: 10/163,376

(22) Filed: Jun. 7, 2002

(65) Prior Publication Data

US 2003/0011588 A1 Jan. 16, 2003

(30) Foreign Application Priority Data

Jul. 11, 2001 (KR) ..... 2001-41562

(51) Int. Cl.
*G09G 5/00* (2006.01)

(52) U.S. Cl. ..... 345/204; 345/87; 345/89; 345/99; 345/100; 345/211; 345/213; 348/220; 348/231; 348/715; 348/716; 348/718; 386/33; 386/34; 386/38

(58) Field of Classification Search ..... 345/211, 345/212, 87, 88, 89, 204, 98, 99, 213, 100; 348/220.1

See application file for complete search history.

(56) References Cited

U.S. PATENT DOCUMENTS 5,767,916 A * 6/1998 West ..... 348/537
5,841,430 A * 11/1998 Kurikko ..... 345/213
6,005,557 A * 12/1999 Wong ..... 345/204
6,069,619 A * 5/2000 Kim ..... 345/211
6,078,317 A * 6/2000 Sawada ..... 345/204
6,337,682 B1 * 1/2002 Hwang ..... 345/213
6,404,422 B1 * 6/2002 Choi ..... 345/211
6,538,648 B1 * 3/2003 Koike et al. ..... 345/213
6,559,837 B1 * 5/2003 Lasneski et al. ..... 345/204
6,587,101 B2 * 7/2003 Yoo ..... 345/211
6,693,628 B1 * 2/2004 Hase et al. ..... 345/213

FOREIGN PATENT DOCUMENTS

JP 2000-338923 12/2000
KR 1999-69420 9/1999

OTHER PUBLICATIONS

Korean Notice to submit response issued by the Korean Intellectual Property Office on Jun. 18, 2003, and English translation.

* cited by examiner

*Primary Examiner*—Richard Hjerpe
*Assistant Examiner*—Jennifer T Nguyen
(74) *Attorney, Agent, or Firm*—Robert E. Bushnell, Esq.

(57) ABSTRACT

An apparatus and method for displaying an out-of-range mode which has a resolution higher than a mode supported by a monitor is provided. The method for displaying an out-of-range mode in monitor displaying includes the steps of (a) sensing received horizontal and vertical synchronizing signals and determining a display mode, and (b) adjusting a sampling rate so that a received video signal is displayed in a supported display mode in a case where the display mode is a mode excluding a supported display mode as a result of determination in step (a). The out-of-range mode which has a resolution higher than a mode supported by an LCD monitor so that a user's system can be easily and conveniently converted into a supported mode without additional apparatus or equipment, can be displayed in the LCD monitor.

19 Claims, 3 Drawing Sheets

APPARATUS AND METHOD FOR DISPLAYING OUT-OF-RANGE MODE

CLAIM OF PRIORITY

This applicatiom makes references to, incorporates the same herewith, and claims all benefits accruing under 35 U.S.C. §119 from an application for AN APPARATUS AND METHOD FOR DISPLAYING OUT-OF-RANGE MODE earlier filed in the Korean Industrial Property Office on 11 Jul. 2001, and there duly assigned Serial No. 41562/2001 by that Office.

BACKGROUND OF THE INVENTION

1. Field of the Invention

The present invention relates to a display unit and a method therefor, and more particularly, to an apparatus and method for displaying an out-of-range mode which has a resolution higher than that of a supported mode of a monitor.

2. Description of the Related Art

In general, a monitor can display video signals at various video modes such as super video graphic adapter mode (SGVA, 800×600), extended graphic adapter mode (XGA, 1024×768), and super extended graphic adapter mode (SXGA, 1280×1024). The video signals are transmitted from a video card of a linked main frame, that is, a personal computer (PC) or a work station, to a screen through a series of signal processing.

Further, as the size of a display unit such as a monitor using a cathode ray tube (CRT), becomes increasingly larger according to the development of modem technology, or as a digital monitor using a liquid crystal display (LCD), which is representative of flat-screen display units which are appropriate for large-sized monitors, becomes more common, the display resolution increases.

A monitor such as an LCD, receives video signals and horizontal and vertical synchronizing signals output from a host (not shown) for displaying pictures. At this time, the monitor displays the video signals in synchronization with the horizontal and vertical synchronizing signals. Here, a display mode for video signals generated in a host is not limited to one kind of mode, various kinds of modes can occur according to the kind of video card installed in a host.

For example, a display mode that can be displayed by a monitor may be XGA. On the other hand, if the mode of the video cards installed in a host is SXGA (hereinafter, referred to as an out-of-range mode), an on-screen display (OSD) warning is displayed on the monitor informing a user that the monitor cannot support such mode, or the monitor automatically turns off.

Here, in a case where a user's monitor is set to an out-of-range mode, the monitor must somehow be converted into a supported mode. However, in order to convert the mode of a monitor into a supported mode, the monitor must be replaced with a monitor capable of supporting a mode that is presently set. This also applies to a case where a user converts the mode of a monitor into an out-of-range mode by mistake.

SUMMARY OF THE INVENTION

To solve the above problems, it is a first object of the present invention to provide an apparatus for displaying an out-of-range mode which has a resolution higher than a mode supported by an LCD monitor so that a user's system can be easily and conveniently converted into a supported mode without additional apparatus or equipment.

It is a second object of the present invention to provide a method for displaying an out-of-range mode which has a resolution higher than a mode supported by an LCD monitor so that a user's system can be easily and conveniently converted into a supported mode without additional apparatus or equipment.

Accordingly, to achieve the first object, there is provided an apparatus for displaying an out-of-range mode. The apparatus includes a signal converting means for generating a sampling clock signal from received horizontal and vertical synchronizing signals and a control signal and converting an analog signal into a digital signal, a signal processing means for signal-processing so that the digital signal output from the signal converting means and a predetermined clock signal are output to a monitor, and a controlling means for outputting a control signal for adjusting a sampling rate through the signal converting means so that received video signals are displayed in a supported display mode in a case where a display mode is determined from the received horizontal and vertical synchronizing signals and the display mode is a mode excluding a supported display mode.

In order to achieve the second object, there is provided a method for displaying an out-of-range mode in a monitor. The method includes the steps of (a) sensing received horizontal and vertical synchronizing signals and determining a display mode, and (b) adjusting a sampling rate so that a received video signal is displayed using a supported display mode in a case where the display mode is a mode excluding a supported display mode as a result of determination in step (a).

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Hereinafter, the present invention will be described in detail by describing preferred embodiments of the invention with reference to the accompanying drawings.

Figure 1:
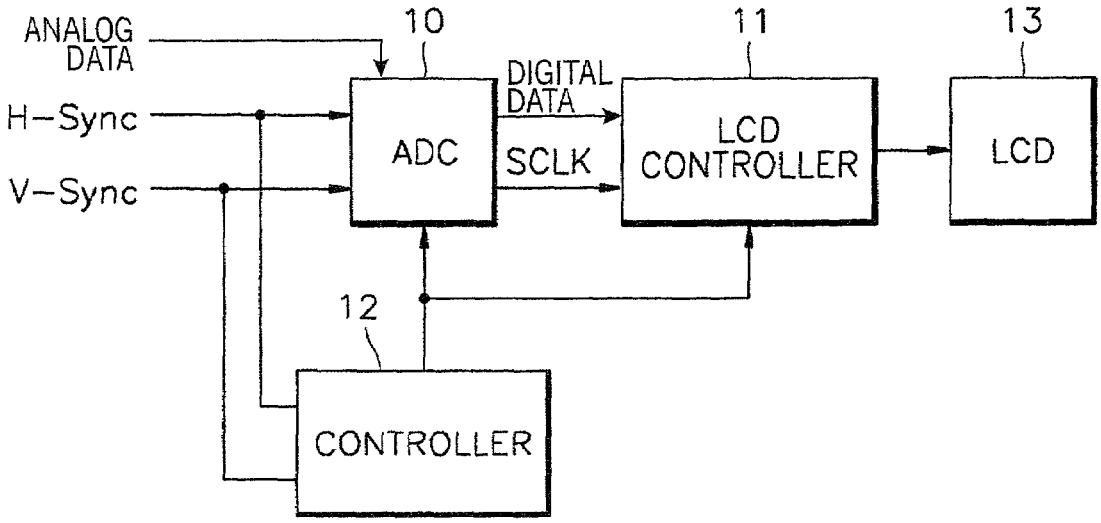
FIG. 1 is a block diagram illustrating the structure of an apparatus according to the present invention for displaying an out-of-range mode.

FIG. 1 is a block diagram illustrating the structure of an apparatus according to the present invention for displaying a received video signal having a display mode that is determined to be either an out-of-range mode of a supported display mode of a monitor or a supported display mode of the monitor. The apparatus shown in FIG. 1 includes an analog-digital converter (ADC) 10 for generating a sampling clock signal from received horizontal and vertical synchronizing signals H-Sync and V-Sync and a received control signal, and for converting an analog video signal into a digital video signal, a liquid crystal display (LCD) controller 11 for scaling and generating data in response to the clock signal output from the ADC 10 to display the data, a controller 12 for determining a display mode from the received horizontal and vertical synchronizing signals H-Sync and V-Sync, communicating with each block, and controlling each block, and a LCD 13.

Figure 2:
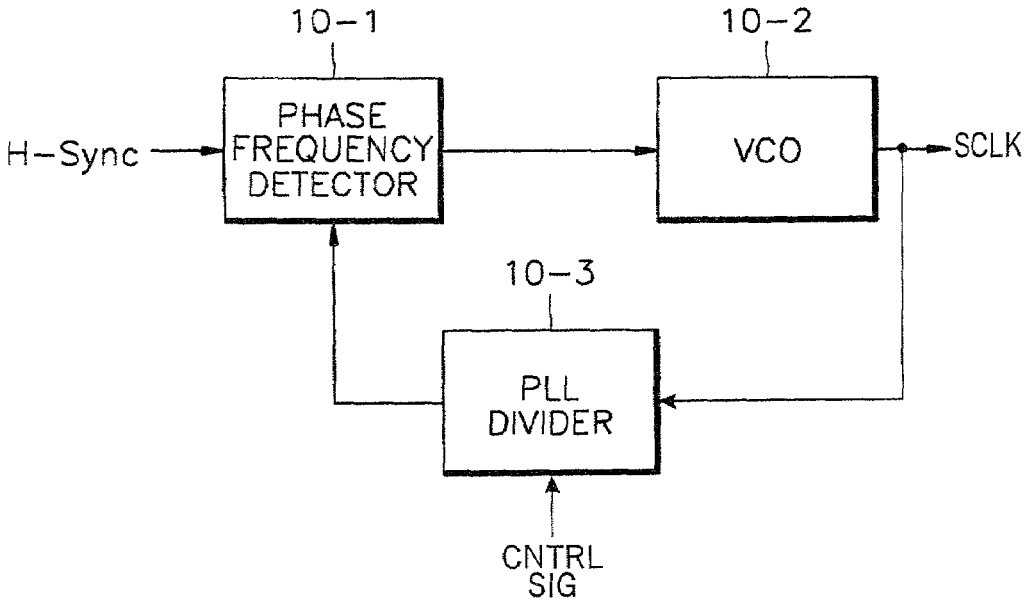
FIG. 2 is a detailed diagram of a phase locked loop (PLL) included in an analog-digital converter (ADC) of FIG. 1.

FIG. 2 is a detailed diagram of a phase locked loop (PLL) included in an analog-digital converter (ADC) of FIG. 1. The PLL shown in FIG. 2 includes a phase frequency detector 10-1 for comparing the received horizontal synchronizing signal H-Sync with a divided sampling clock signal SCLK and outputting a phase difference, a voltage controlled oscillator (VCO) 10-2 for generating a sampling clock signal corresponding to the phase difference output from the phase frequency detector 10-1, and a PLL divider 10-3 for varying the division rate of the sampling clock signal generated in the VCO 10-2 according to the control signal CNTRL SIG output from the controller 12 and outputting the varied division rate. The PLL divider 10-3 may be an internal or external PLL divider.

FIGS. 3A–3D are waveform diagrams of the apparatus of FIG. 1.

Hereinafter, the apparatus for displaying an out-of-range mode will be described with reference to FIGS. 1 through 3D.

The ADC 10 generates a received horizontal synchronizing signal H-Sync and a locked sampling clock signal SCLK using the PLL divider 10-3 and converts sampled received analog data into digital data. The LCD controller 11 performs signal processing for display using the digital data and the clock signal SCLK output from the ADC 10 and outputs a processed signal to the LCD 13. Referring to FIG. 2, which is a detailed diagram of the ADC 10 for generating a locked sampling clock signal SCLK, the phase frequency detector 10-1 compares the received synchronizing signal H-Sync with the divided locked sampling clock signal SCLK output from the PLL divider 10-3 and outputs a phase difference. The VCO 10-2 outputs the locked sampling clock signal SCLK having a clock frequency corresponding to the phase difference and transmits the the locked sampling clock signal SCLK to the PLL divider 10-3. The PLL divider 10-3 receives a dividing control signal CNTRL SIG from the controller 12, divides the locked sampling clock signal SCLK, and outputs the divided locked sampling clock signal to the phase frequency detector 10-1.

If the horizontal and vertical synchronizing signals H-Sync and V-Sync are input to the controller 12, the controller 12 determines whether and how often the received horizontal and vertical synchronizing signals H-Sync and V-Sync have been input thereto to determine a display mode. If the controller 12 cannot sense the received horizontal and vertical synchronizing signals H-Sync and V-Sync, a control signal for operating a monitor in a power saving mode is output to the LCD controller 11. If the display mode is decided, the controller 12 transmits control signals for controlling the operation of the ADC 10 and the LCD controller 11 to correspond to the determined display mode. In such a case, a division value for the PLL divider 10-3 for determining the frequency of a sampling clock signal is set, and the frequency of the sampling clock signal is obtained by Equation 1.

$$F_{SCLK}=F_{H\text{-}sync}/n \qquad \text{[Equation 1]}$$

wherein, $F_{SCLK}$ is the frequency of the sampling clock signal SCLK, $F_{H\text{-}sync}$ is the frequency of the horizontal synchronizing signal H-sync and n is division value for PLL divider.

Here, the division value for the PLL divider is the total number of horizontal pixels in a horizontal sync (Hsync) period of an input display mode. The total number of horizontal pixels in a horizontal sync (Hsync) period and the total number of vertical pixels in a vertical sync (Vsync) period of a video signal are known quantities determined by VESA (Video Electronics Standards Association) and include those pixels in the blanking areas and the pixels in the viewed (active) area of a displayed video signal.

In the LCD controller 12, without a frame rate convert (FRC) function in that the frequency of an output vertical synchronizing signal V-Sync is maintained at a constant level even though the frequency of a received vertical synchronizing signal V-Sync is different, the received vertical synchronizing signal V-Sync and the output vertical synchronizing signal V-Sync are maintained at a constant level, and an output clock frequency (pixel clock) is obtained by Equation 2.

$$Fclk_{out}(Hz)=(Fclk_{in}(Hz)\times \mathrm{HorizontalTotal}_{in}\times \mathrm{VerticalTotal}_{in})/(\mathrm{HorizontalTotal}_{out}\times \mathrm{VerticalTotal}_{out})=\mathrm{HorizontalTotal}_{out}\times \mathrm{VerticalTotal}_{out}\times F_{V\text{-}syncin} \qquad \text{[Equation 2]}$$

wherein, $\mathrm{Fclk}_{out}$(Hz) is the output clock frequency, $\mathrm{Fclk}_{in}$ (Hz) is the input clock frequency, $\mathrm{HorizontalTotal}_{in}$ is the total input horizontal pixels, $\mathrm{VerticalTotal}_{in}$ is the total input vertical pixels, $\mathrm{HorizontalTotal}_{out}$ is the total output horizontal pixels, $\mathrm{VerticalTotal}_{out}$ is the total output vertical pixels and $F_{V\text{-}syncin}$ is the frequency of the input vertical sync signal (refresh rate).

In a case where the display mode is determined by the controller 12 to be an out-of-range mode, that is, in a case where the display mode is determined by the controller 12 to be an unsupported display mode, the input clock frequency (Hz) is large, and thus the output clock frequency (Hz) becomes large. Then, in the case of the LCD 13, which has a maximum output clock frequency that is set, the input clock (Hz) cannot correspond to the output clock frequency (Hz), and thus display is not possible.

In this case, if the input clock frequency (Hz) is lowered, the output clock frequency (Hz) is naturally lowered, and thus, the input clock frequency (Hz) can correspond to the output clock frequency (Hz). In order to lower the input clock frequency (Hz), the input clock frequency (Hz) is down-sampled. For this purpose, the controller 12 adjusts the division value of the PLL divider 10-3. That is, a value smaller than an input display mode, as the division value of the PLL divider 10-3, is set by the controller 12 and output to the ADC 10 (PLL divider 10-3), thereby generating an output clock frequency (Hz) according to the standard of the LCD 13. The maximum display mode depends on the set division value of the PLL divider 10-3.

In the case of a supported display mode, the controller 12 sets a division value of the PLL divider 10-3 that is appropriate for the input display mode in the ADC 10. If the controller 12 determines the display mode to be a supported display mode, the controller 12 passes the display mode. If the controller 12 determines the display mode to be an out-of-range display mode, the controller 12 sets the division value of the PLL divider 10-3 by down-sampling of the input clock frequency (Hz) in the ADC 10.

For example, if a supported mode in the controller 12 is an XGA mode (1024×768, horizontal frequency: 48.363 Hz, vertical frequency: 60 Hz, and total horizontal pixels: 1344), the maximum output clock frequency is 80 MHz. However, if the input display mode is a SXGA mode (1280×1024, horizontal frequency: 79.976 Hz, vertical frequency: 75 Hz, total horizontal pixels: 1688, and total vertical pixels: 1085), it is determined to be an out-of-range mode because the output clock frequency of the input display mode exceeds the maximum output clock frequency of 80 MHz. In such a case, the division value of the PLL (total horizontal pixels) is adjusted by down-sampling and the output clock frequncy (Hz) is obtained by Equation 2 as shown below.

$$\begin{aligned} Fclk_{out}(\text{Hz}) &= (Fclk_{in}(\text{Hz}) \times HorizontalTotal_{in} \times VerticalTotal_{in}) / \\ &\quad (HorizontalTotal_{out} \times VerticalTotal_{out}) \\ &= HorizontalTotal_{out} \times VerticalTotal_{out} \times F_{V\text{-}syncin} \\ &= HorizontalTotal_{out} \times VerticalTotal_{in} \times (Vr_{out} / Vr_{in}) \times F_{V\text{-}syncin} \\ &= 1344 \times 1085 \times (768/1024) \times 75 \text{ Hz} = 82 \text{ Mhz} \end{aligned}$$

wherein $Vr_{out}$ is the output vertical resoloution and $Vr_{in}$ is the input vertical resolution. Since the result of 82 Mhz is out-of-range, the controller 12 sets the value for $HorizontalTotal_{out}$ to a lower value.

Here, the output clock frequency is 75 MHz, in a case where the total output horizontal pixels ($HorizontalTotal_{out}$), the division value of the PLL divider 10-3, is set to 1230 in the controller 12. Thus, the output clock frequency can follow the standard (usually, maximum: 80 MHz or so) of a conventional XGA LCD panel.

In the case of an out-of-range mode, smooth display is not possible due to the lack of the number of data. However, a screen which is capable of changing mode setting in a user's system can be provided, and an on-screen display (OSD) warning for changing the mode setting is displayed to a user, thereby informing the user that the display mode is not right. The user then resets the display mode.

Figures 3A, 3B, 3C, 3D:
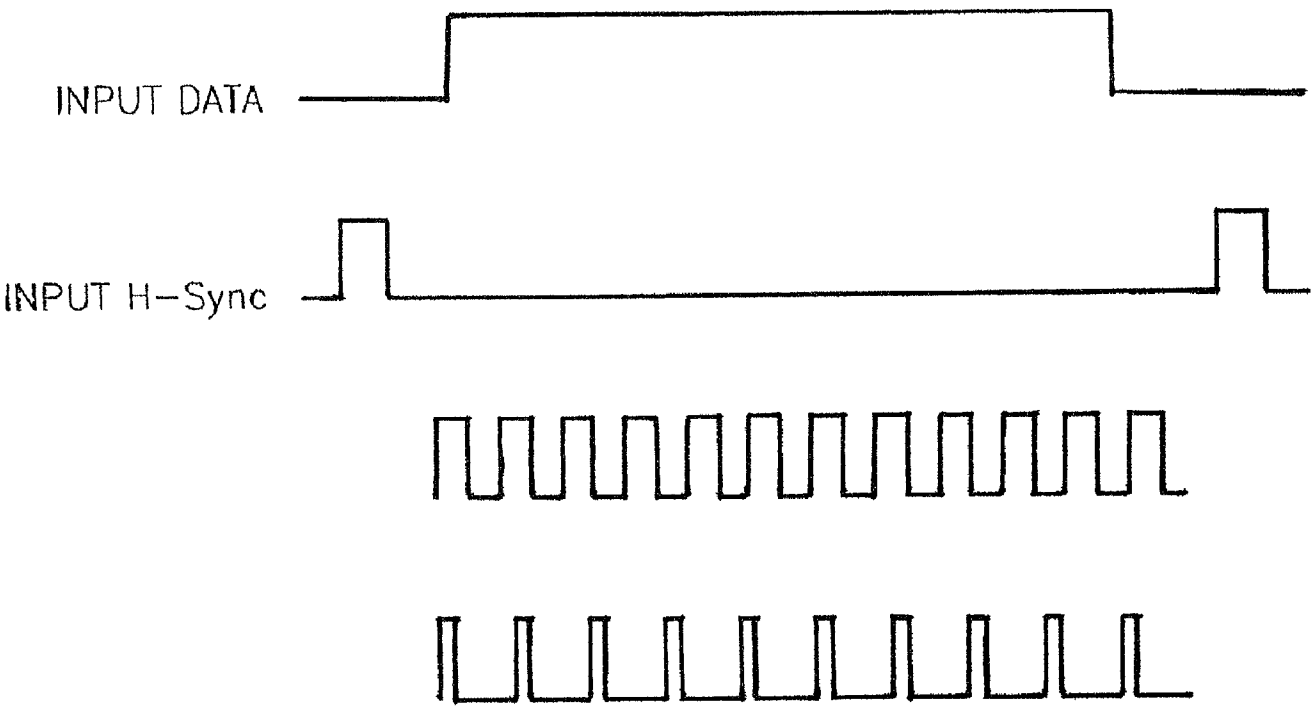
FIGS. 3A through 3D are waveform diagrams of the apparatus of FIG. 1.

FIGS. 3A through 3D are waveform diagrams of the ADC 10. Specifically, FIG. 3A is a waveform diagram of input data, and FIG. 3B is a waveform diagram of a received horizontal synchronizing signal H-Sync. Also, FIGS. 3C and 3D are waveform diagrams of a locked sampling clock signal (SCLK), that is, FIG. 3C is a waveform diagram of a locked sampling clock signal (SCLK), which is output from the VCO 10-2 when the display mode is supported by the controller 12, and FIG. 3D is a waveform diagram of a locked sampling clock signal (SCLK), which is down-sampled when the display mode (i.e., out-of-range mode) is not supported by the controller 12.

Figure 4:
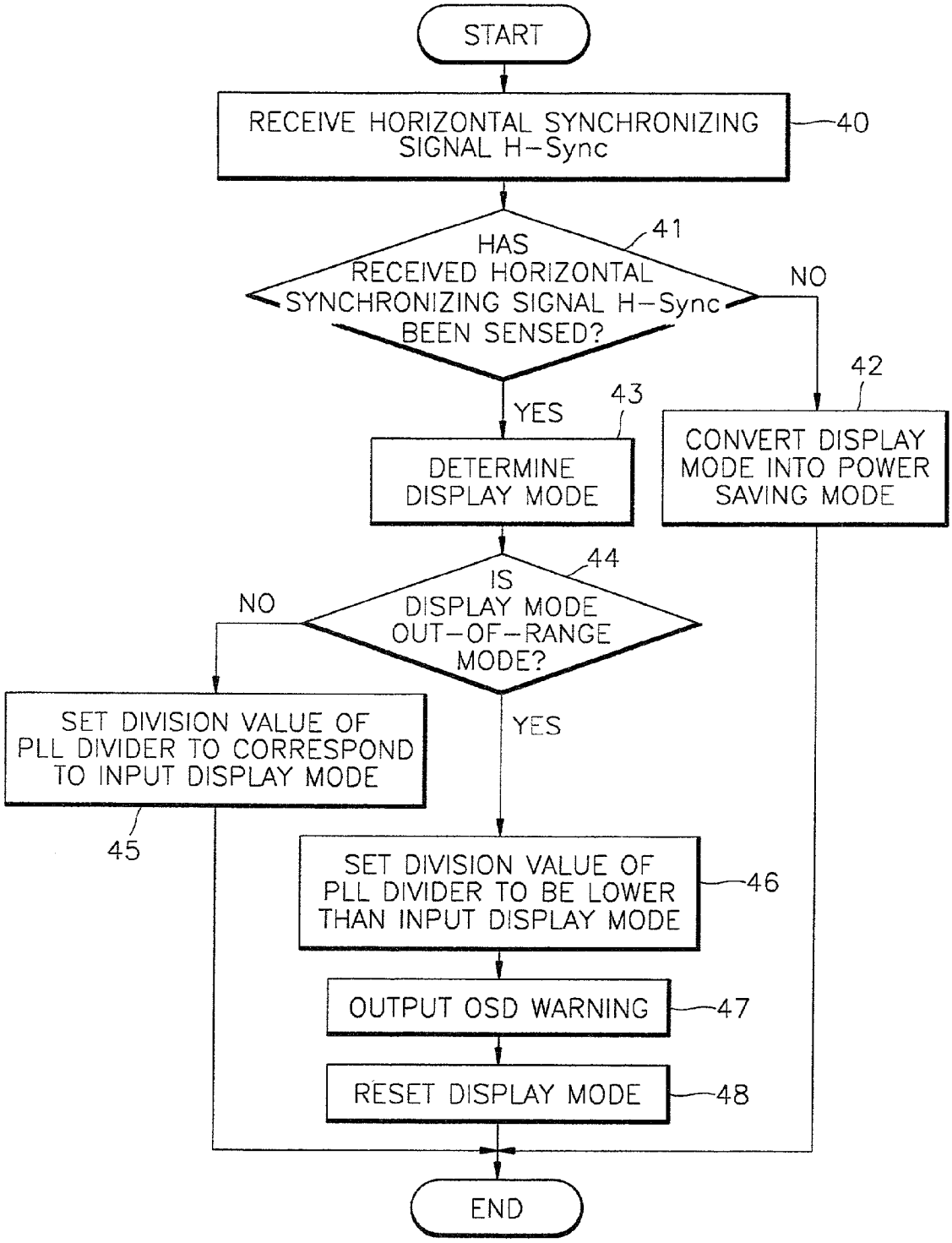
FIG. 4 is a flow chart illustrating a method according to the present invention for displaying an out-of-range mode.

FIG. 4 is a flow chart illustrating a method according to the present invention for displaying an out-of-range mode.

The flow chart shown in FIG. 4 includes receiving a horizontal synchronizing signal H-Sync in step 40, sensing and determining the received horizontal synchronizing signal H-Sync in step 41, converting the display mode into a power saving mode in step 42, determining a display mode in step 43, determining an out-of-range mode in step 44, setting the division value of a PLL divider to correspond to an input display mode in step 45, setting the division value of the PLL divider to be lower than the input display mode in step 46, outputting an OSD warning in step 47, and resetting the display mode in step 48.

Hereinafter, a method for displaying an out-of-range mode will be described in greater detail with reference to FIG. 4.

The controller 12 receives received horizontal and vertical synchronizing signals H-Sync and V-Sync in step 40. The display mode of the controller 12 can be determined upon reception of the received horizontal and vertical synchronizing signals H-Sync and V-Sync.

The controller 12 determines whether the received horizontal synchronizing signal H-Sync has been sensed in step 41 and converts a monitor into a power saving mode if the received horizontal synchronizing signal H-Sync is not sensed by the controller 12 in step 42. A case where the received horizontal synchronizing signal H-Sync is not sensed by the controller 12 means that there are no input data. Thus, since it is not necessary to operate the monitor and waste power, the monitor is converted into a power saving mode.

If the controller 12 senses the received horizontal synchronizing signal H-Sync, the controller 12 determines a display mode in step 43. The controller 12 determines whether and how often the horizontal and vertical synchronizing signals are received and supports signal processing according to the determined display mode.

The controller 12 determines whether the display mode is an out-of-range mode or not in step 44.

If the display mode is not an out-of-range mode, that is, if the display mode can be supported by the controller 12, the division value of a PLL divider is set in step 45 to correspond to the input display mode. In the above case, in order to convert received analog data and clock signals into digital data and clock signals, the ADC 10 generates a received horizontal synchronzing signal H-Sync and a locked sampling clock signal (SCLK) by using a PLL divider 10-3 and converts the sampled received analog data into digital data. In such a case, the division value of the PLL divider 10-3 is set by the controller 12.

In a case where the display mode is determined to be an out-of-range mode, that is, in a case where the display mode cannot be supported by the controller 12, the division value of the PLL is set to be lower than the input display mode in step 46. In the above case, the input clock frequency (Hz) is large, and thus, the output clock frequency (Hz) becomes large. Then, in the case an of the LCD 13, which has a maximum output clock frequency that is set, the input clock frequency (Hz) cannot correspond to the output clock frequency (Hz), and thus display is not possible. In this case, if the input clock frequency (Hz) is lowered, the output clock frequency (Hz) is naturally lowered, and thus the input clock frequency (Hz) can correspond to the output clock frequency (Hz). In order to lower the input clock frequency (Hz), the input clock frequency (Hz) is down-sampled. For this purpose, the controller 12 adjusts the division value of the PLL divider 10-3. That is, a value smaller than an input display mode, as the division value of the PLL divider 10-3, is set by the controller 12 and output to the ADC 10 (PLL divider 10-3), thereby generating an output clock frequency (Hz) according to the standard of the LCD 13.

The down-sampled out-of-range mode is displayed, and an OSD warning is output in step 47. In the case of an out-of-range mode, smooth display is not possible due to the lack of the number of data. However, a screen which is capable of changing mode setting in a user's system can be provided, and an on-screen display (OSD) warning for changing the mode setting is displayed to a user, thereby informing the user that the display mode is not right.

The user who has seen the output of OSD resets a display mode in step 48.

As described above, according to the present invention, the out-of-range mode which has a resolution higher than a mode supported by an LCD monitor so that a user's system can be easily and conveniently converted into a supported mode without additional apparatus or equipment. Although smooth display is not possible due to the lack of the number of data, a screen which is capable of changing mode setting in a user's system can be provided, and an on-screen display (OSD) warning for changing mode setting is displayed to a user, thereby informing the user that the display mode is not right. Further, there are no increased or additional costs in the present invention, and the present invention can be easily applied to an existing model.

While this invention has been particularly shown and described with reference to a preferred embodiment thereof, it will be understood by those skilled in the art that various changes in form and details maybe made therein without departing from the spirit and scope of the invention as defined by the appended claims.

What is claimed is:

1. An apparatus for displaying a received video signal having a display mode that is determined to be either an out-of-range mode of a supported display mode of a monitor or a supported display mode of the monitor, the apparatus comprising:

an analog-to-digital signal converting generating a sampling clock signal in response to received horizontal and vertical synchronizing signals and a received control signal, said analog-to-digital signal converter converting an analog signal into a digital signal representative of the received video signal in response to said sampling clock signal;

a signal processor signal-processing the digital signals, output from the analog-to-digital signal converter, in response to the sampling clock signal, output from the analog-to-digital signal converter, the processed digital signal being applied to an input of a monitor; and a controller determining whether the received video signal has a display mode that is the out-of-range mode or the supported display mode in response to said received horizontal and vertical synchronizing signals, and outputting a corresponding control signal, said control signal being provided to said analog-to-digital signal converter for controlling a sampling rate of said sampling clock signal so that the digital signal input to said monitor and representing the received video signal is displayed on said monitor in the supported display mode.

2. The apparatus as claimed in claim 1, wherein the analog-to-digital signal converter comprises:

a signal sensor comparing the received horizontal synchronizing signal with a divided sampling clock signal and outputting a phase difference;

a clock generator generating the sampling clock signal, said sampling clock signal corresponding to the phase difference; and a divider generating the divided sampling clock signal by varying a division value of the sampling clock signal generated in the clock generator according to the control signal output from said controller.

3. The apparatus as claimed in claim 2, wherein the signal sensor comprises a phase detector, the clock generator comprises a voltage controlled oscillator, and the divider comprises a phase lock loop divider.

4. The apparatus as claimed in claim 1, wherein the controller outputs a control signal for operating the monitor in a power saving mode through the signal processor when the controller does not sense the horizontal or vertical synchronizing signals.

5. The apparatus as claimed in claim 1, wherein the controller outputs a control signal to the signal processor for displaying a warning message, when the controller determines the display mode to be the out-of-range mode.

6. The apparatus as claimed in claim 5, wherein the display mode can be reset if a warning message is displayed.

7. An apparatus for displaying a received video signal having a display mode that is determined to be either an out-of-range mode of a supported display mode of a monitor or a supported display mode of the monitor, the apparatus comprising:

an analog-to-digital converter generating a sampling clock in response to a received horizontal synchronizing signal and a control signal, said analog-to-digital converter converting an analog video signal to a digital video signal in response to said sampling clock;

a controller responsive to the received horizontal synchronizing signal for determining a pixel clock frequency of said received video signal and determining whether said pixel clock frequency is supported by said monitor;

said controller generating a first control signal when it is determined that said pixel clock frequency is not supported by said monitor, said first control signal being provided to said analog-to-digital converter for lowering a frequency of said sampling clock; and said controller generating a second control signal when it is determined that said pixel clock frequency is supported by said monitor, said second control signal being provided to said analog-to-digital converter for said sampling clock, said sampling clock having a frequency corresponding to said pixel clock frequency.

8. The apparatus as claimed in claim 7, said analog-to-digital converter comprising:

a voltage controlled oscillator for generating said sampling clock;

a phase detector for comparing a phase of the received horizontal synchronizing signal to a phase of a divided sampling clock signal, said phase detector outputting a phase control signal to said voltage controlled oscillator as a result of comparing the phase of the received horizontal synchronizing signal to the phase of the divided sampling clock signal; and a phase lock loop divider responsive to said first or second control signals for dividing said sampling clock and outputting said divided sampling clock signal to said phase detector, wherein said divided sampling clock signal is lowered when said first control signal is input to said phase lock loop divider.

9. The apparatus as set forth in claim 8, further comprising:

a liquid crystal display controller for scaling said digital video signal and preparing said digital video signal for display on a liquid crystal display monitor in response to said sampling clock output from said voltage controlled oscillator.

10. The apparatus as set forth in claim 9, said liquid crystal display controller generating an on-screen display warning for display on said liquid crystal display monitor in response to said first control signal.

11. The apparatus as set forth in claim 7, further comprising:

a liquid crystal display controller for scaling said digital video signal and preparing said digital video signal for display on a liquid crystal display monitor in response to said sampling clock output from said analog-to-digital converter.

12. The apparatus as set forth in claim 11, said liquid crystal display controller generating an on-screen display warning for display on said liquid crystal display monitor in response to said first control signal.

13. The apparatus as set forth in claim 11, said liquid crystal display controller controlling said liquid crystal display monitor to operate in a power saving mode in response to a power control signal generated by said controller, when said controller fails to receive said horizontal synchronizing signal.

14. The apparatus as set forth in claim 7, said controller controlling said monitor to operate in a power saving mode when said controller fails to receive said horizontal synchronizing signal.

15. A method for displaying a received video signal having a display mode that is determined to be either an out-of-range mode of a supported display mode of a monitor or a supported display mode of the monitor, the method comprising the steps of:

generating, by an analog-to-digital converter, a sampling clock signal from received horizontal and vertical synchronizing signals and a received control signal;

converting, by said analog-to-digital converter, an analog video signal into a digital video signal;

scaling and generating data, by a liquid crystal display controller, in response to the sampling clock signal to display the data; and determining, by a controller, a display mode from the received horizontal and vertical synchronizing signals; and adjusting a sampling rate of the sampling clock signal of the analog-to-digital converter so that the analog video signal is converted to a digital video signal supported by the display mode of the monitor, when the display mode is determined to be the out-of-range mode.

16. The method as claimed in claim 15, wherein the adjusting step comprises:

setting the sampling rate to a rate lower than a sampling rate of the received video signal when the display mode of the received video signal is determined to be the out-of-range mode; and setting the sampling rate to a rate corresponding to the sampling rate of the received video signal when the display mode of the received video signal is determined to be the supported display mode.

17. The method as claimed in claim 15, further comprising a step of operating the monitor in a power saving mode when the horizontal or vertical synchronizing signals are absent.

18. The method as claimed in claim 15, further comprising a step of displaying a warning message when the display mode of the received video signal is determined to be the out-of-range mode.

19. The method as claimed in claim 18, further comprising a step of resetting the display mode when the warning message is displayed.

* * * * *